US006296157B1

(12) United States Patent
Erb

(10) Patent No.: US 6,296,157 B1
(45) Date of Patent: Oct. 2, 2001

(54) LIQUID DISPENSING TAP

(75) Inventor: Rene Erb, Phalsbourg (FR)

(73) Assignee: Scholle Corporation, Irvine, CA (US)

( * ) Notice: Subject to any disclaimer, the term of this patent is extended or adjusted under 35 U.S.C. 154(b) by 0 days.

(21) Appl. No.: 09/461,739

(22) Filed: Dec. 16, 1999

(30) Foreign Application Priority Data

Jan. 11, 1999 (FR) ..... 99 00254

(51) Int. Cl.[7] ..... B67D 3/00
(52) U.S. Cl. ..... 222/509; 222/518; 222/559
(58) Field of Search ..... 222/505, 509, 222/511, 513, 514, 518, 559

(56) References Cited

U.S. PATENT DOCUMENTS 4,687,123 * 8/1987 Hyde ..... 222/518
4,741,355 * 5/1988 Credle, Jr. et al. ..... 222/505

FOREIGN PATENT DOCUMENTS 0 213 783 3/1987 (EP) .
0 432 070 6/1991 (EP) .
2 101 275 1/1983 (GB) .
2 169 061 7/1986 (GB) .
WO 97/48614 12/1997 (WO) .

* cited by examiner

*Primary Examiner*—J. Casimer Jacyna
(74) *Attorney, Agent, or Firm*—Young & Thompson

(57) ABSTRACT

A tap for dispensing liquids, essentially constituted by a body (1) for mounting in the outlet of a receptacle and for dispensing liquid, in a rigid manner, by a flap or a sealing closure membrane (2) for an opening (3) for dispensing the liquid, provided with a control member (4) and disposed in the portion of the body (1) opposite that for mounting in the outlet, and by an actuating device (5) for the control member (4). The body is made of a composite material by conjoint injection or co-molding in a single molded piece integrating the actuating device (5) for the control member (4) of the flap or of the sealing closure membrane (2) of the opening (3) for dispensing the liquid, by spring force, via a resiliently deformable membrane constituted by a flexible material with permanent spring effect, the rest of the body (1) being constituted of a rigid material.

26 Claims, 4 Drawing Sheets

Fig-2
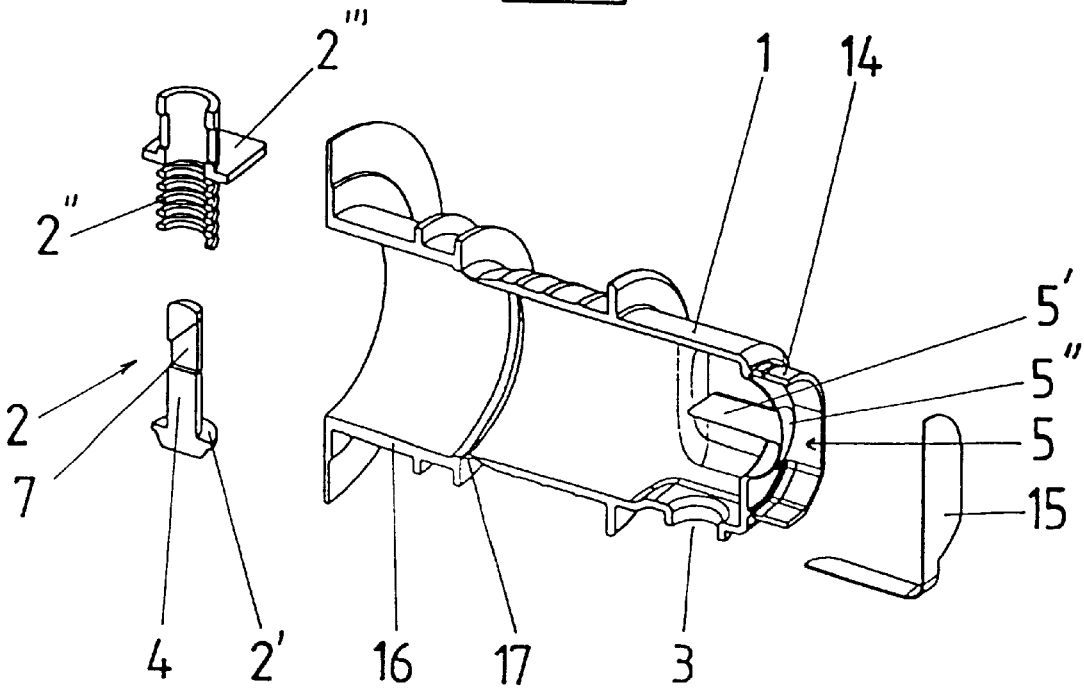
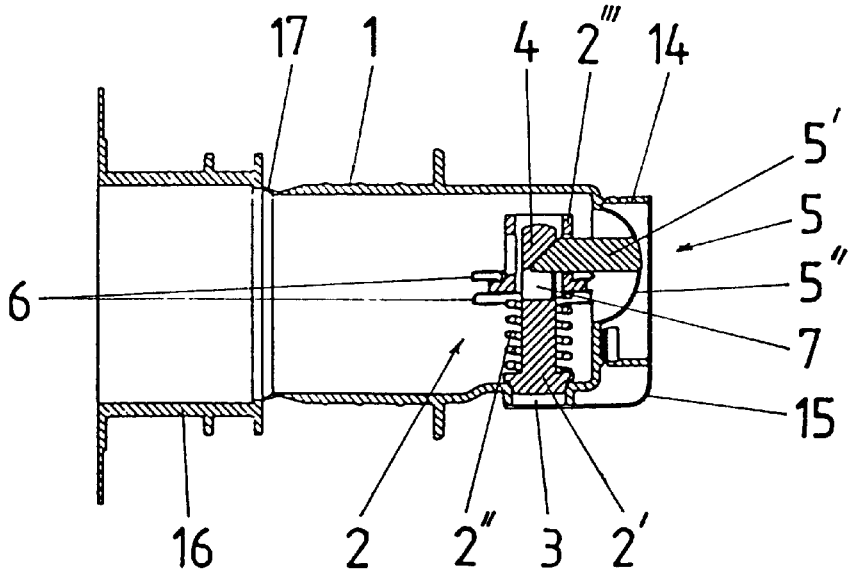
Fig-1

LIQUID DISPENSING TAP

FIELD OF THE INVENTION

The present invention relates to the field of production of taps for dispensing liquids contained in small rigid, semi-rigid or flexible containers, in particular comestible liquids, and has for its object such a tap.

BACKGROUND OF THE INVENTION

At present, the dispensing of comestible beverages, particularly table wines, fruit juice or pasteurized milk, from small rigid, semi-rigid or flexible containers, such as wine containers of synthetic material, generally takes place by means of taps fixed on the outlet of these receptacles.

To this end, there are known taps constituted by a body for mounting in the outlet of a receptacle and by a piston for releasing liquid, loaded by a spring and guided in the body, the piston acting on a resilient sealing membrane secured to the body. The mounting body in the outlet is provided with a securement handle coacting by snapping on the outlet.

Such taps permit correct dispensing of the liquid and are perfectly suitable, either for a bottling operation or for a series of withdrawals, whether these latter be carried out in a sterile environment, such as a sterile chamber for aseptic filling, or not, for example for filling glasses or small receptacles, which is to say for private or restaurant use for small flows of a single beverage or a single vintage.

There are also known taps for distributing liquids, particularly comestible liquids that are sterile or not, with an automatic closure, which are constituted by a body for mounting in the outlet of a receptacle and by a piston for releasing liquid acting on a resilient sealing membrane secured to the body, these taps being provided with means for holding the piston in open position.

There exist still other taps of the beverage type, in which the passage of the liquid is effected by aligning the passage openings by means of a lever or a manipulating handle.

All these known taps permit fulfilling correctly their essential function of sealingly closing a receptacle with the possibility of withdrawing the liquid contents. However, given the relatively large number of their constituent pieces, requiring corresponding mounting operations, their cost is greatly affected by these operations, such that in these taps, the cost of the material forming their constituent pieces is only a small part of their sales price.

It is also known to provide a tap for the dispensing of liquids, comprising a flap or sealed closure member for a dispensing opening of the liquid, manipulated by means of a control device forming a part of a front closure membrane. Such a tap has, however, the drawback of not permitting guaranteeing perfect and lasting closure of the outlet for the liquid after manipulation. Thus, in these taps, the flap or closure membrane is not guided and moreover, the manipulating means is subject to rapid fatigue, preventing the continued elastic memory necessary to guarantee sealed closure.

There is also known, from EP-A-0 213 783, a tap for carbonated liquids comprising a diaphragm manipulated by means of two handles. This tap is provided with an interface serving as a diaphragm and acting on a piston which is secured to said diaphragm, this diaphragm being actuated by means of two handles extending above it. To this end, it is necessary to apply a strong opening force by means of the handles, so as to deform the diaphragm in the opening direction of the valve of the tap.

This difficulty of opening the diaphragm is due to the fact that it is made of the same material as the body of the tap, in a single molding operation. It results that the diaphragm or dome, secured to the piston, is not naturally resilient but only by its construction during production, the elasticity or semi-rigidity necessary for its deformation for actuating the piston being obtained only by the provision of circular lines of weakening in the form of grooves.

Thus, such a tap cannot be monostable, which is to say have a resilience permitting reliable spring force, without counter-pressure. Thus, the flexibility of the diaphragm or dome alone is not sufficient to ensure correct alternate opening and closing of the tap and only the pressure of the product enclosed in the container provided with this tap is adapted to guarantee the closure by acting on the piston and to guarantee sealing.

SUMMARY OF THE INVENTION

The present invention has for its object to overcome these drawbacks of existing taps and to provide a tap giving a very high oxygen barrier, easily manipulable, guaranteeing automatic closure without supplemental action by the contents, and whose production of the constituent pieces and their assembly can be carried out in a simple and rapid manner, such that their market price can be substantially decreased.

According to the invention, the tap for dispensing liquids, which is essentially constituted by a body to be mounted in the outlet of a receptacle for dispensing liquid, by a flap or sealing closure member of an outlet for the liquid, provided with a control member, is disposed in the portion of the body opposite the portion for mounting in the outlet, and by actuating means for said control member, is characterized in that the body for mounting in the outlet of a receptacle for dispensing liquid, is made of a composite material produced by conjointly injecting or co-molding in a single molded piece integrating the actuating means for the control member of the flap or of the sealing closure member of the outlet for dispensing liquid by spring force, by means of a resiliently deformable membrane constituted of a flexible material with permanent spring force, the rest of the body being constituted by a rigid material.

BRIEF DESCRIPTION OF THE DRAWINGS

The invention will be better understood from the following description, which relates to preferred embodiments, given by way of non-limiting examples, and explained with reference to the accompanying schematic drawings, in which:

FIG. 1 is a side elevational and cross-sectional view of the tap according to the invention;

FIG. 2 is an exploded perspective cross-sectional view of the tap of FIG. 1;

DESCRIPTION OF THE PREFERRED EMBODIMENT

Figure 3:
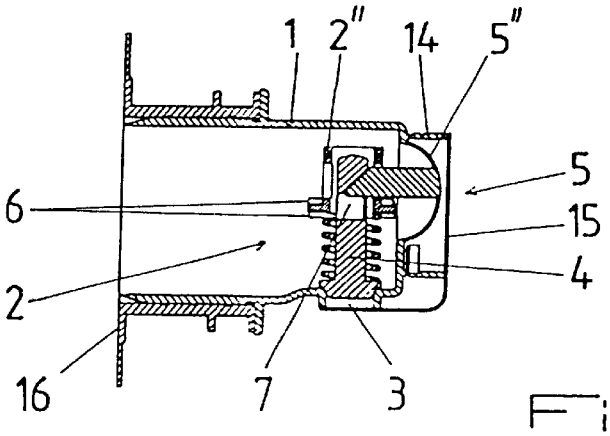
FIG. 3 is a view similar to that of FIG. 1 of the tap in the service position, before its first use.
Figure 4:
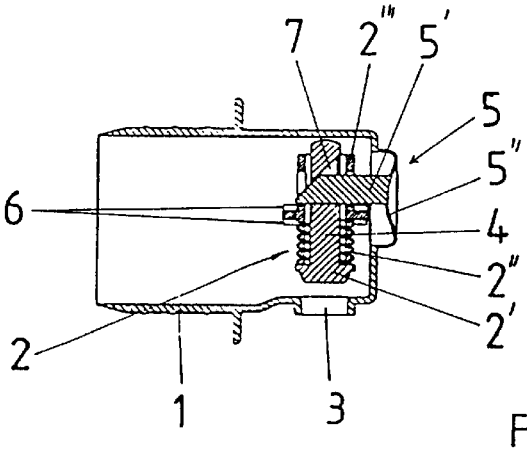
FIG. 4 is a cross-sectional view analogous to that of FIG. 3, showing the tap in the open position.

FIGS. 1 to 8 of the accompanying drawings show a tap for the dispensing of liquids, which is essentially constituted by a body 1 for mounting in the outlet of a receptacle (not shown) for dispensing of the liquid, by a flap or sealed closure membrane 2, by an opening 3 for dispensing the liquid, provided with a control member 4 disposed in the portion of the body 1 opposite the mounting portion in the outlet, and by actuating means 5 for said control member 4.

According to the invention, and as shown more particularly by way of example in FIGS. 1 to 8 of the accompanying drawings, the body 1 for mounting in the outlet of a receptacle for dispensing liquid, is made of a composite material by conjoint injection or co-molding, in a single molded piece integrating the actuating means 5 for the control member 4 of the flap or sealing closure member 2, for the opening 3 for dispensing liquid, by spring effect, by means of a resiliently deformable membrane constituted of a flexible material with permanent spring effect, the rest of the body 1 being constituted by a rigid material. Such a construction of 1the rest of the body 1 permits ensuring good gripability of this latter.

Thus, the body 1 and the actuating means 5 for the control member 4 of the flap or closure membrane 2 of the opening 3 for dispensing liquid, can be made simply and easily by a single molding operation, by conjoint injection or co-molding of two materials having different mechanical characteristics. Moreover, the sealing between the means 5 and the body 1 is perfectly ensured.

According to one characteristic of the invention, and as shown more particularly in FIGS. 1 to 3 and 8 of the accompanying drawings, the flap or closure membrane 2 of the opening 3 for dispensing liquid is preferably constituted by a piston whose head 2' coacts shape-matingly with the opening 3 for dispensing liquid and which is loaded by a compression spring 2", said piston being provided with a piston rod forming the control member 4 and being guided in a stirrup 2'" for mounting in the body 1, above the dispensing opening 3.

According to a first embodiment, shown in FIGS. 1, 3 to 5, 7 and 10 of the accompanying drawings, the compression spring 2" bears directly on the rear surface of the piston constituting the flap or closure membrane 2 of the opening 3 for dispensing liquid, surrounds the piston rod forming the control member 4 or extends on opposite sides of said rod (FIG. 10), and is connected at its other end to the stirrup 2'" for mounting in the body 1, above the dispensing opening 3. Thus, the assembly of the constituent elements of the flap or of the closure membrane 2 of the opening 3 for dispensing liquid, can preferably be made by molding in a single piece. Such an embodiment of the flap or membrane 2 permits on the one hand simple production at low cost and, on the other hand, limitation of the pieces of the tap, such that the assembly operations are reduced and the corresponding cost can accordingly be reduced.

Figure 10:
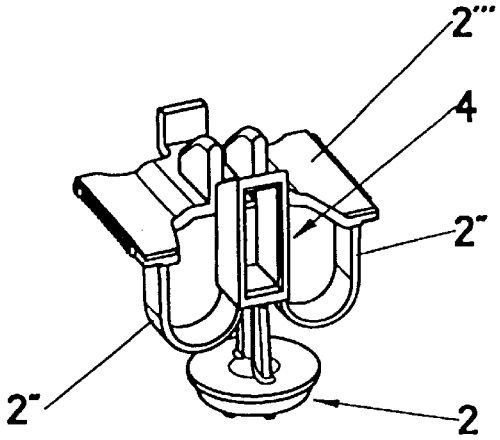
FIG. 10 is a perspective view on a larger scale of an embodiment of a control member for the flap or membrane.

According to the embodiment shown in FIG. 10 of the accompanying drawings, the compression spring 2" is constituted by a pair of resilient blades each connected by one end to the end of the piston rod forming the control member 4 and by its other end to the stirrup 2'" for mounting in the body 1, the assembly of the control member 4 and flap or membrane 2 and stirrup 2'" being made of a single piece by molding, the resilient blades forming the compensation spring 2" effecting the guidance of the piston rod.

The stirrup 21'" for mounting the flap or closure member 2 of the opening 3 for dispensing liquid, in the body 1, above the dispensing opening 3, coacts, in the service position, by means of the edges of the free ends of its wings, with the parallel guide rails 6 provided in the body 1, on opposite sides of the dispensing opening 3. Thus, it is possible to provide easy assembly of the flap or membrane 2 by simple insertion of the edges of the free ends of the wings of the stirrup 2'" in the parallel guide rails 6 provided in the body 1. At the end of assembly of the stirrup 2'", the head 2' of the flap or membrane 2 is automatically positioned over the opening 3 for dispensing liquid and instantaneously closes this latter in a sealed manner.

The control member 4 forming the piston rod constituting the flap or membrane 2 has a free end portion disposed in the stirrup 2'", passing through the end of this latter opposite the dispensing opening 3 of the body 1 and provided with a device 7 for connection with the corresponding end of the actuating means 5 entering the body 1. This connection device 7 can be in the form of a hole traversed by the corresponding shape-mating end of the actuating means 5 (FIGS. 1, 3 to 5, 6, 7, 8 and 10). The device 7 can also be constituted by two parallel grooves, inclined relative to the axis of the control member 4, near its free end, and coacting with the corresponding end in the form of a fork, of the actuating means 5.

The actuating means 5 of the member 4 for controlling the flap or sealed closure membrane 2 of the opening 3 for dispensing liquid, is preferably constituted by a manipulating rod 5' extending into the body 1, parallel to the longitudinal axis of this latter, made of a rigid material, coacting at one end, within said body 1, with the connection device 7 for the corresponding end of the control member 4, and by a control button 5" forming the deformable elastic membrane, which is preferably made of a flexible material with permanent spring force, conjointly injected or co-molded with the body 1 and with the manipulating rod 5' and connected, on the one hand, sealingly with the end of the body 1 that is opposite the end of mounting in the outlet of the receptacle and, on the other hand, with the end of the manipulating rod 5' opposite the flap or sealed closure member 2 of the opening 3 for dispensing liquid. The shape of the control button 5" of flexible material with permanent spring force permits easy manipulation of the rod 5', whilst ensuring complete sealing of the tap.

The free end of the manipulating rod 5' is preferably in the shape of a wedge and coacts with a correspondingly sloped wall of the connection device 7 for the corresponding end of the control member 4. Thus, by pressure on the control button 5", the manipulating rod 5' enters the recess forming the connection device 7 and, by coaction of its wedge-shaped end with the correspondingly sloped wall of said recess, the rod 5' exerts pressure on the corresponding end of the control member 4 for the flap or sealing closure member 2 of the opening 3 for dispensing liquid, such that said flap or membrane 2 is raised from its seat over the dispensing opening 3 and opens the liquid passage.

Figure 5:
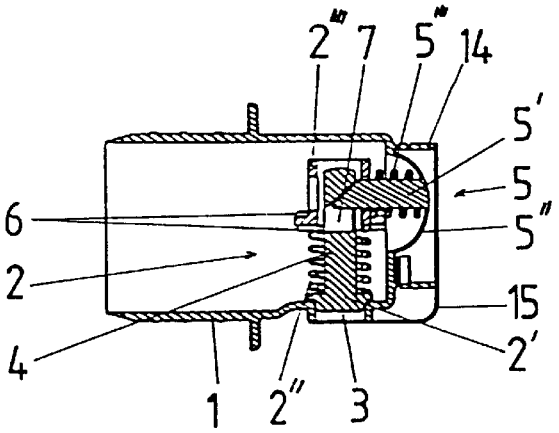
FIGS. 5 to 7 are cross-sectional views analogous to those of FIG. 4, of modified embodiments of the invention.

FIG. 5 of the accompanying drawings shows a modified embodiment of the invention, in which the control button 5" of the actuating means 5 for the control member 4 of the flap or sealing closure member 2 for the opening 3 for dispensing liquid, is loaded by a return spring 5'" preferably mounted on the manipulating rod 5'" and secured, on the side opposite the control button 5'" of the stirrup 2'" for mounting the flap or closure membrane 2 of the opening 3 for dispensing liquid, in the body 1. The provision of such a return spring 5'" permits optimizing the manipulation of the control button 5" by encouraging its return to the rest position after each manipulation of the flap or of the membrane 2, such that the closing action of said flap or membrane 2 by the compression spring 2" is promoted and a perfectly sealed closure of the opening 3 for dispensing of the liquid can be obtained.

Figure 6:
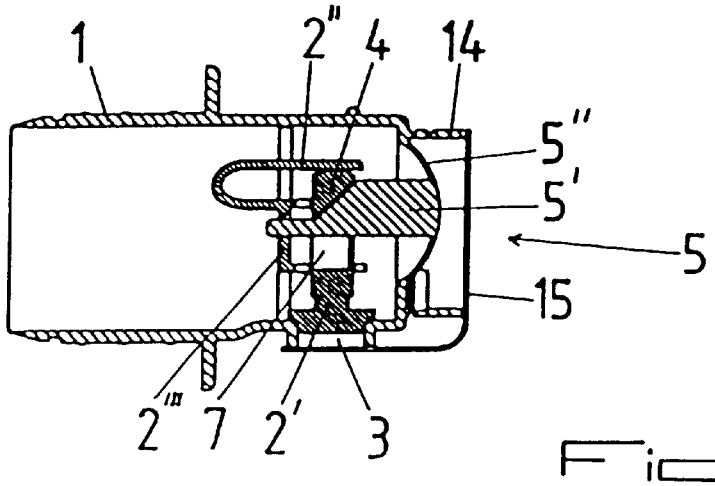

FIG. 6 of the accompanying drawings shows another modified embodiment of the invention, in which the compression spring 2" is in the form of a curved blade, connected by one end to the upper end of the stirrup 2'", resiliently deformable and bearing at its other free end on the end of the piston rod forming the control member 4 for the flap or membrane 2. In this embodiment, the end of the blade bearing on the end of the piston rod forming the control member 4 can also be secured to this end, such that the assembly of the constituent elements of the flap or membrane 2 can be made by molding of a single piece.

Figure 7:
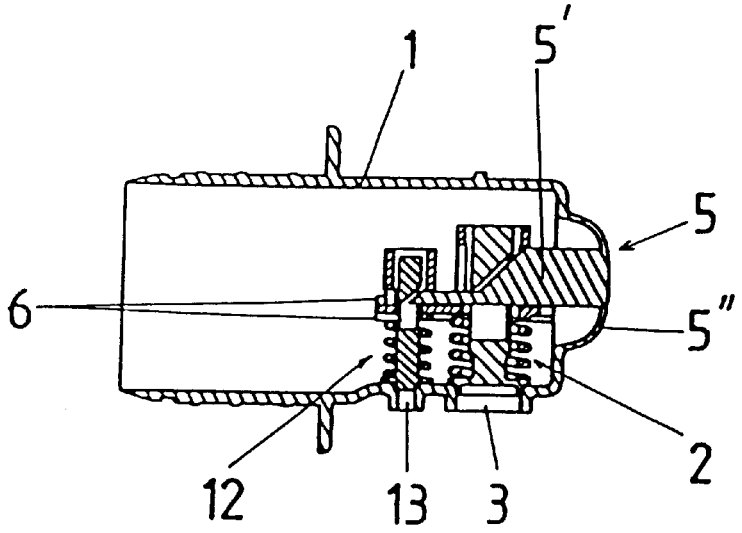

FIG. 7 of the accompanying drawings shows another modified embodiment of the invention, in which the flap or sealed closure membrane 2 for the opening 3 for dispensing liquid is duplicated by a second flap or sealed closure membrane 12 for an air inlet opening 13, this flap or membrane 12 being manipulated by means of the actuating means 5 of the control member 4 of said flap or sealed closure member 2 for the opening 3 for dispensing liquid. The construction of this second flap or sealed closure membrane 12 of an air inlet opening 13 can be identical to that of the flap or sealed closure membrane 2 of the opening 3 for dispensing liquid, the cross-section of the opening 13 being preferably less than that of the opening 3 for dispensing of the liquid. A tap thus formed is particularly adapted for mounting on a rigid container, whose tap requires an air intake. This tap permits the correct emptying of the package, without mishap, the liquid which flows out being replaced by a siphoning effect by air entering through the opening 13, this following a single manipulation of the means 5.

The flaps or membranes 2 and 12, respectively, for sealed closure of the opening 3 for dispensing liquid and for sealed closure of the air inlet opening 13, can preferably be made from a single one-piece molding. Thus, the flaps or membranes 2 and 12 can be mounted by a single rapid simple operation, in the body 1.

Figure 8:
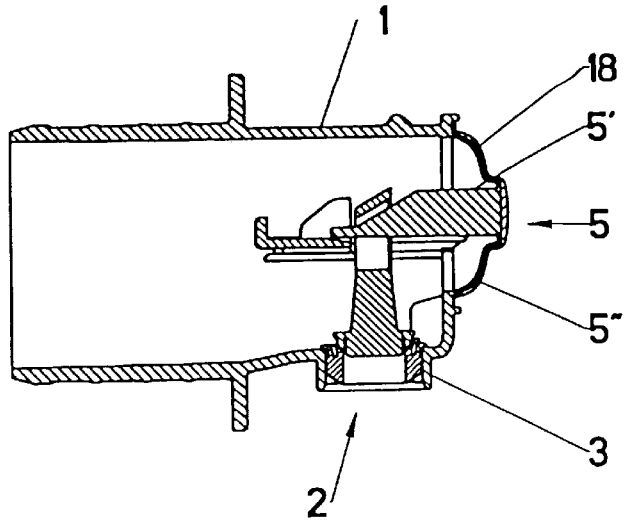
FIG. 8 is a view similar to that of FIG. 1, of another modified embodiment of the invention.
Figure 9:
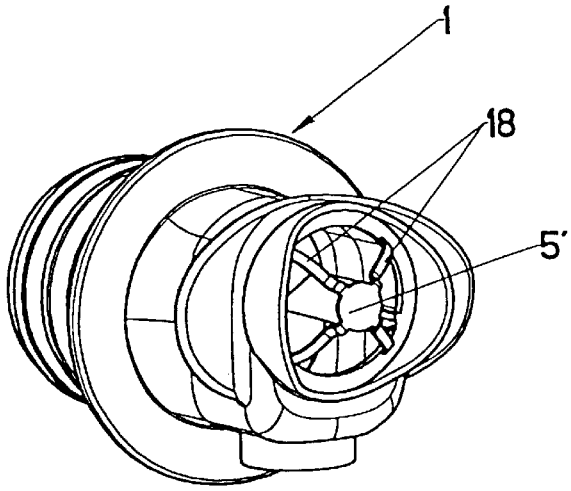
FIG. 9 is a perspective view of the tap according to FIG. 8, without the means for actuating the control member.

FIGS. 8 and 9 of the accompanying drawings show another modified embodiment of the invention, in which the manipulating rod 5' constituting the actuating means 5 for the control member 4 for the flap or sealed closure membrane 2 of the opening 3 for dispensing liquid, is preferably connected to the corresponding end of the body 1 by means of flexible bridges 18 made of the same material as said rod 5' and the body 1 and overmolded in the same flexible material constituting the membrane forming the control button 5", in the course of co-molding or conjoint injection of the assembly. The production of the flexible bridges 18 of the same rigid material as the body 1 and the rod 5' permits simultaneous molding of these bridges and of the rod 5' during the first portion of the co-molding or conjoint injection and a perfect centering of said rod 5' during molding of the flexible membrane forming the control button 5", in the course of the second portion of said co-molding or said conjoint injection. Thus, the mold for the tap can be simplified, the manipulating rod 5' being connected to the body 1 and not requiring specific holding during the second portion of the operation of co-molding or conjoint injection.

According to another characteristic of the invention, and as shown in FIGS. 1 to 3 and 5 of the accompanying drawings, the tap can be provided moreover with a destructible guarantee device 14 secured to the body 1 and present in the form of a tear-off collar surrounding the portion of the actuating means 5 and, if desired, the abutment 11 projecting from the body 1. Thus, action on the actuating means 5 can take place only after first tearing off the destructible guarantee device 14.

According to another characteristic of the invention, the guarantee thus obtained can be supplemented by the provision on the destructible guarantee device 14 of a tear-off and thermosealable film 15 closing said guarantee device 14 over the actuating means 5 and, if desired, the abutment 8, this film 15 being preferably adapted to provide a tax stamp and being adapted to cover moreover the opening or openings 3 and 13. As a result, upon the first use of the tap, during freeing of the actuating means 5 by tearing off the destructible guarantee device 14, the tax stamp applied to the film 15 is destroyed and any fraud by reuse is impossible.

Preferably, the tear-off film 15 can be made of a single piece with the destructible guarantee device 14, of identical or different material, and can simply have a thickness less than that of said destructible guarantee device 14. As a result, this embodiment of tap is inviolable during transportation and storage. Thus, the necessary security, particularly for the packaging of sterile comestible liquids, is ensured and illicit use is instantly detected.

Finally, according to another characteristic of the invention, and as shown more particularly in FIGS. 1 to 3 of the accompanying drawings, the body 1 for mounting in the outlet of a receptacle and for dispensing liquid is preferably connected to a base portion 16, forming a throat and adapted to be connected with a container, by an initial connection by means of a destructible physical means 17, the portion of the body 1 connected to the base portion 16 forming a neck being receivable within and lockable in final received position in said base portion 16 forming a neck, after destruction of the physical means 17. Thus, the assembly of the body 1 and the base portion 16 can be fixed in a final and aseptic manner, by welding said base portion 16 over or within a corresponding opening of the container, the body 1 being torn off from the base portion 16 for filling said container, then inserted and locked within said portion 16 after filling.

The destructible physical means 17 is preferably in the form of a weakened strip constituted of the same material as that constituting the base portion 16 and the body 1. There results from this construction the possibility of producing the body 1 and the base portion 16, forming a neck, in a single molding operation in a single mold, such that the monobloc member obtained can be of a substantially lower cost than that of the two pieces used until the present.

Thanks to the invention, it is possible to produce a tap for distributing liquids contained in small rigid, semi-rigid or flexible containers, in particular comestible liquids, comprising only two subassemblies of pieces each obtained in a single molding operation, by co-molding or conjoint injection of different materials, and being adapted to be connected to each other in a simple and rapid manner.

As a result, there is the possibility of producing taps that can be on the one hand rapidly produced by simple molding operations and, on the other hand, that can easily be assembled, without requiring the use of numerous and complex robots for moving and assembling the constituent parts, such that the investment in machinery can be kept to a minimum.

Moreover, the manipulation of these taps with an opening can be carried out with the application of low force and the return to closed position of the flap or of the sealed closure membrane 2 for the opening 3 for dispensing liquid, takes place automatically upon release of pressure on the control button 5", the tap being monostable without counter pressure, because of the flexibility of said button in the form of a resiliently deformable membrane.

Of course, the invention is not limited to the embodiments described and shown in the accompanying drawings. Modifications remain possible, particularly as to the construction of the various elements or by substitution of technical equivalents, without thereby departing from the scope of protection of the invention.

What is claimed is:

1. A liquid dispensing tap, comprising:

a body for mounting in an outlet of a receptacle;

a flap or sealing closure membrane for an opening for dispensing the liquid by spring action, by a deformable resilient membrane constituted of a flexible material with permanent spring effect, the opening being provided with a control member disposed in a portion of the body opposite that for mounting the outlet;

actuating means for actuating said control member;

said body being made of a composite material by conjoint injection or co-molding in a single molded piece integrating the actuating means, the rest of the body being of rigid material;

said flap or closure membrane comprising a piston having a head which coacts shape-matingly with the opening, and which is loaded by a compression spring;

said piston being provided with a piston rod which forms the control member, and being guided in a stirrup for mounting in the body over the opening;

said compression spring comprising a pair of resilient blades for guiding the piston rod, each blade having a first end connected to an end of the piston rod and a second end connected to the stirrup, and the assembly comprised of the control member, the flap or closure membrane, and the stirrup being made of a single piece by molding.

2. The tap according to claim 1, wherein the control member has a free end portion disposed within the stirrup, passing through an end of said stirrup opposite the opening and provided with a connection device for connection with a corresponding end of the actuating means entering the body.

3. The tap according to claim 2, wherein the connection device is in the form of a hole traversed by the corresponding shape-mating end of the actuating means.

4. The tap according to claim 2, wherein the connection device is constituted by two parallel grooves inclined relative to the axis of the control member, adjacent its free end, and coacting with the corresponding end in the form of a fork of the actuating means.

5. The tap according to claim 1, wherein the actuating means comprises a manipulating rod extending into the body, parallel to the longitudinal axis thereof, and coacting with one end within said body, with a connection device of a corresponding end of the control member, and by a control button forming the deformable resilient membrane, which is conjointly injected or co-molded with the body and with the manipulating rod and connected in a sealed manner with the end of the body opposite to that of mounting in the outlet of the receptacle and with the end of the manipulating rod opposite the flap or the sealing closure membrane.

6. The tap according to claim 5, wherein the free end of the manipulating rod is in the form of a wedge and coacts with a correspondingly slanting wall of the connection device of the corresponding end of the control member.

7. The tap according to claim 5, wherein the manipulating rod is connected to the end of the body by flexible bridges made of the same material as said manipulating rod and the body, and overmolded by the flexible material constituting the membrane forming the control button, in the course of co-molding or conjoint injection of the assembly.

8. The tap according to claim 1, further comprising a destructible guarantee device, secured to the body and in the form of a tear-off collar surrounding the portion of the actuating means projecting from the body.

9. The tap according to claim 8, wherein the destructible guarantee device is completed by a tearable and thermosealable film closing said guarantee device above the actuating means, said film being provided with a tax stamp and being adapted simultaneously to cover the opening and an air inlet.

10. The tap according to claim 9, wherein the tearable film is made of a single piece with the destructible guarantee device, of a different or identical material.

11. The tap according to claim 1, wherein the body is connected to a base portion, forming a neck and adapted for connection with a container, by an initial connection to a destructible physical member, the portion of the body connected to the base portion forming a neck that is receivable and lockable in final inserted position in said base portion forming a neck after destruction of the physical member.

12. The tap according to claim 11, wherein the destructible physical member is in the form of a weakened strip constituted of the same material as that of the base portion and of the body.

13. A liquid dispensing tap, comprising:

a body for mounting in an outlet of a receptacle;

a flap or sealing closure membrane for an opening for dispensing the liquid by spring action, by a deformable resilient membrane constituted of a flexible material with permanent spring effect, the opening being provided with a control member disposed in a portion of the body opposite that for mounting the outlet;

actuating means for actuating said control member;

said body being made of a composite material by conjoint injection or co-molding in a single molded piece integrating the actuating means, the rest of the body being of rigid material;

said flap or closure membrane comprising a piston having a head which coacts shape-matingly with the opening, and which is loaded by a compression spring;

said piston being provided with a piston rod which forms the control member, and being guided in a stirrup for mounting in the body over the opening;

said stirrup comprising wings having edges which coact, in a service position, with parallel guide rails provided in the body, on opposite sides of the opening.

14. The tap according to claim 13, wherein the compression spring is in the form of a curved blade, connected by one end to the upper end of the stirrup, elastically deformable and bearing with its free end on an end of the piston rod.

15. The tap according to claim 14, wherein the end of the blade bearing on the end of the piston rod is secured to said end of the piston rod, such that the assembly of the constituent elements of the flap or the membrane, can be made by molding in a single piece.

16. The tap according to claim 13, wherein the control member has a free end portion disposed within the stirrup, passing through an end of said stirrup opposite the opening and provided with a connection device for connection with a corresponding end of the actuating means entering the body.

17. The tap according to claim 16, wherein the connection device is in the form of a hole traversed by the corresponding shape-mating end of the actuating means.

18. The tap according to claim 16, wherein the connection device is constituted by two parallel grooves inclined relative to the axis of the control member, adjacent its free end, and coacting with the corresponding end in the form of a fork of the actuating means.

19. The tap according to claim 13, wherein the actuating means comprises a manipulating rod extending into the body, parallel to the longitudinal axis thereof, and coacting with one end within said body, with a connection device of a corresponding end of the control member, and by a control button forming the deformable resilient membrane, which is conjointly injected or co-molded with the body and with the manipulating rod and connected in a sealed manner with the end of the body opposite to that of mounting in the outlet of the receptacle and with the end of the manipulating rod opposite the flap or the sealing closure membrane.

20. The tap according to claim 19, wherein the free end of the manipulating rod is in the form of a wedge and coacts with a correspondingly slanting wall of the connection device of the corresponding end of the control member.

21. The tap according to claim 19, wherein the manipulating rod is connected to the end of the body by flexible bridges made of the same material as said manipulating rod and the body, and overmolded by the flexible material constituting the membrane forming the control button, in the course of co-molding or conjoint injection of the assembly.

22. The tap according to claim 13, further comprising a destructible guarantee device, secured to the body and in the form of a tear-off collar surrounding the portion of the actuating means projecting from the body.

23. The tap according to claim 22, wherein the destructible guarantee device is completed by a tearable and thermosealable film closing said guarantee device above the actuating means, said film being provided with a tax stamp and being adapted simultaneously to cover the opening and an air inlet.

24. The tap according to claim 23, wherein the tearable film is made of a single piece with the destructible guarantee device, of a different or identical material.

25. The tap according to claim 13, wherein the body is connected to a base portion, forming a neck and adapted for connection with a container, by an initial connection to a destructible physical member, the portion of the body connected to the base portion forming a neck that is receivable and lockable in final inserted position in said base portion forming a neck after destruction of the physical member.

26. The tap according to claim 25, wherein the destructible physical member is in the form of a weakened strip constituted of the same material as that of the base portion and of the body.

* * * * *